US005672051A

United States Patent [19]

Forgue et al.

[11] Patent Number: 5,672,051

[45] Date of Patent: Sep. 30, 1997

[54] POWER-MANAGED FUEL DELIVERY SYSTEM

[75] Inventors: John R. Forgue, Cheshire; George H. Bucci, South Windsor, both of Conn.

[73] Assignee: Walbro Corporation, Cass City, Mich.

[21] Appl. No.: 501,602

[22] Filed: Jul. 12, 1995

[51] Int. Cl.[6] ..... F04B 49/06

[52] U.S. Cl. ..... 417/44.11; 123/497

[58] Field of Search ..... 417/44.1, 44.11; 318/151, 152, 139, 478, 479, 803, 806; 123/495, 497

[56] References Cited

U.S. PATENT DOCUMENTS

| | | | |
|---|---|---|---|
| 4,399,200 | 8/1983 | Galloway | 429/23 |
| 4,523,563 | 6/1985 | Moore et al. | 123/359 |
| 4,577,604 | 3/1986 | Hara et al. | 123/397 |
| 4,628,235 | 12/1986 | Goings | 318/430 |
| 4,782,271 | 11/1988 | Trowbridge | 318/113 |
| 4,791,905 | 12/1988 | Furuta et al. | 123/497 |
| 5,092,302 | 3/1992 | Mohan | 123/497 |
| 5,216,994 | 6/1993 | Aoki et al. | 123/490 |

*Primary Examiner*—Timothy Thorpe
*Assistant Examiner*—Xuan M. Thai
*Attorney, Agent, or Firm*—Barnes, Kisselle, Raisch, Choate, Whittemore & Hulbert

[57] ABSTRACT

A fuel delivery system for an internal combustion engine that includes an electric-motor fuel pump and an electronic control circuit for applying electrical power to the pump motor from a source of d.c. potential. The electronic control circuit is responsive to voltage level at the source of d.c. potential for automatically boosting electrical power applied to the pump motor when voltage available at the source decreases to a preselected level. In the preferred embodiments, the pump motor is a d.c. motor, and the electronic control circuit takes the form of a d.c.-to-d.c. convertor having a transformer and a rectifier circuit coupling the transformer to the motor. Power switches apply alternating current to the transformer when voltage available at the d.c. power source is inadequate, thereby increasing or boosting power applied to the motor through the rectifier circuit.

16 Claims, 3 Drawing Sheets

POWER-MANAGED FUEL DELIVERY SYSTEM

The present invention is directed to fuel delivery systems for internal combustion engines, and more particularly to a power-managed control circuit for boosting electrical power applied to the fuel pump motor when available power is otherwise inadequate.

BACKGROUND AND SUMMARY OF THE INVENTION

Fuel delivery systems for automotive engine applications typically include an electric-motor fuel pump in which pump speed varies as a function of voltage applied to the pump motor. Fuel pump operating voltages can vary from as low as 5.5 VDC during cold starting conditions to as high as 14.5 VDC during normal operation when charging, while the vehicle minimum fuel delivery requirements vary only slightly. For this reason, the motor and pump are conventionally sized to meet desired flow requirements at minimum expected operating voltage, meaning that the pump operates with significant excess capacity during the vast majority of operating time under normal operating conditions. Pump over-design increases current drain, increases noise during normal operation, reduces pump life due to higher operating speed at normal operating condition, and causes excess fuel movement leading to increased evaporative emissions.

A general object of the present invention is to provide a fuel control system in which pump design can be optimized for periods of normal operation, and in which power applied to the pump is automatically boosted to approach normal output at the pump when power available from the power source is at a reduced level. The fuel delivery system in accordance with the invention thus has the advantages of increased system efficiency and lower pump noise. Another object of the present invention is to provide a fuel delivery system of the described character in which the normal failure mode of the voltage control circuit permits the system to continue operation under power from the vehicle power source.

A fuel delivery system for an internal combustion engine in accordance with the present invention includes a fuel pump having an electric motor for driving the pump at a speed that varies as a function of electrical power applied to the pump motor, and electronic control circuitry for applying electrical power to the pump motor from a source of d.c. potential. The electronic control circuitry in the preferred embodiments of the invention is responsive to voltage level at the source of d.c. potential for automatically boosting electrical power applied to the pump motor from the source when voltage available at the source decreases to a preselected level. Alternatively, or in combination with such automatic voltage level response, the control circuitry may be responsive to an external control signal from an engine control unit, or to a signal indicative of an engine operating parameter such as manifold vacuum level, throttle position or engine speed. In the preferred embodiments of the invention, the pump motor is a d.c. motor, and the electronic control circuit takes the form of a d.c.-to-d.c. convertor having a transformer and a rectifier circuit coupling the transformer to the motor. Power switches apply alternating current to the transformer when voltage available at the d.c. power source is inadequate, thereby increasing or boosting power applied to the motor through the rectifier circuit.

The source of d.c. potential is connected to the transformer such that the motor draws power from the d.c. source through the transformer and rectifier during both operation and non-operation of the electronic power switches. In the preferred embodiments of the invention, the electronic power switches are connected to the transformer through fuses, which are sized such that circuit failure at the electronic power switches opens the fuses to permit continued operation of the pump motor from the d.c. source through the transformer and rectifier circuit.

The electronic power switches include first and second power switches coupled to an oscillator for applying current of alternating polarity to the transformer during alternate output cycle portions from the oscillator. A blanking circuit is connected to the oscillator to prevent simultaneous conduction at the first and second power switches during transition of the oscillator output between the alternate cycle portions. In one embodiment of the invention, a current feedback circuit is connected to the power switches and responsive to current in the transfer for terminating operation of the power switches when current in the transformer increases to a preselected level.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
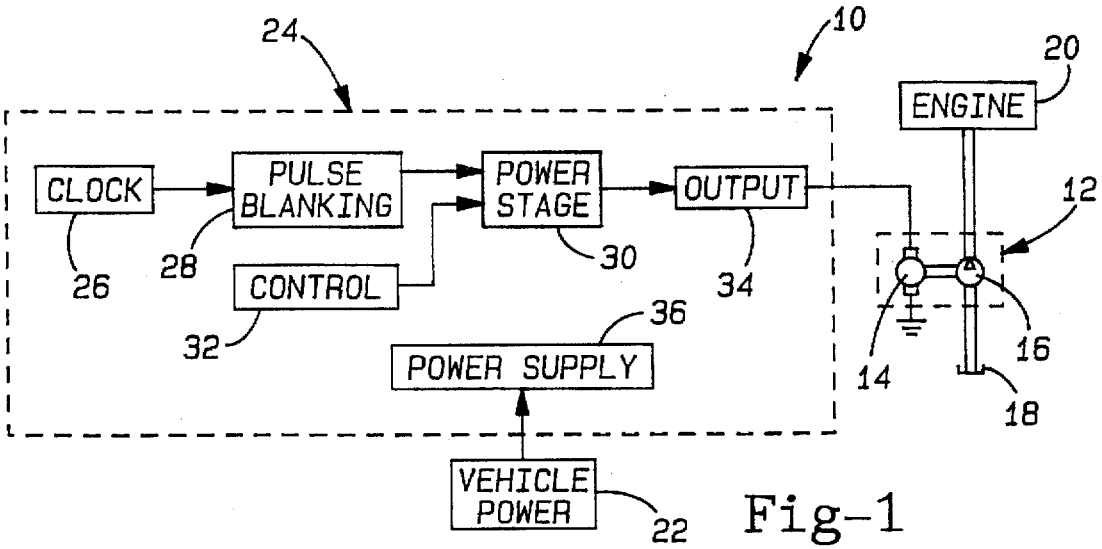
FIG. 1 is a functional block diagram of a fuel delivery system for an internal combustion engine in accordance with the present invention.

FIG. 1 illustrates a fuel delivery system 10 in accordance with the present invention as comprising an electric-motor fuel pump assembly 12 having a d.c. motor 14 coupled to a pump stage 16 for delivering fuel under pressure from a tank or supply 18 to an engine 20. Electrical power is applied to pump motor 14 from a source of vehicle power 22, such as a vehicle battery and charging system, by a power-managed pump control circuit 24 in accordance with the present invention. In general, control circuit 24 includes an oscillator clock 26 connected to a power stage 30 through a pulse blanking stage 28. Power stage 30 also receives an input from a control stage 32 responsive to the level of power available at power source 22. The output of power stage 30 is applied to pump motor 14 through an output stage 34, and control circuit 24 receives power from power source 22 through a circuit power supply 36.

Figure 2:
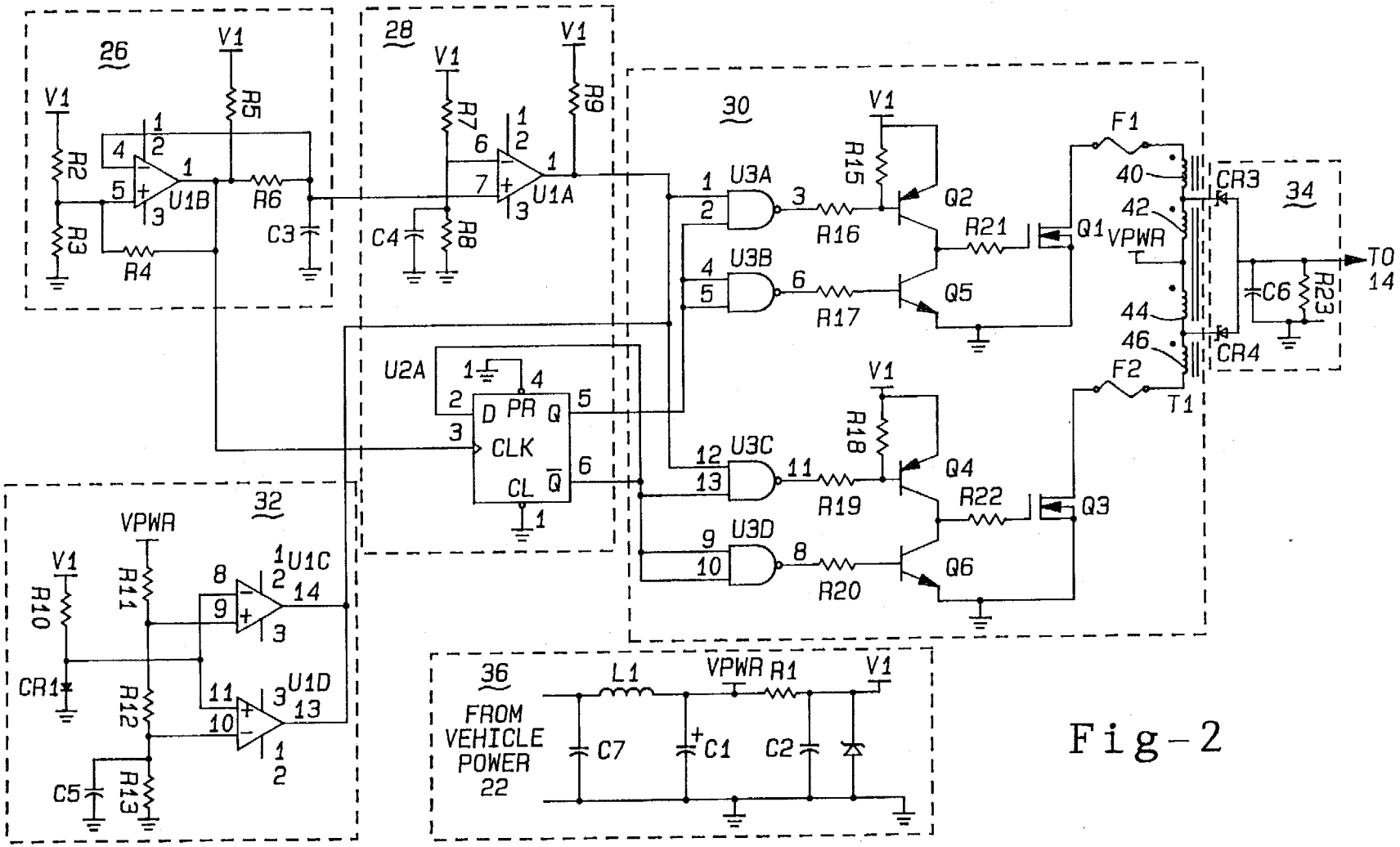
FIG. 2 is an electrical schematic diagram of the power-managed control circuit in the system of FIG. 1 in accordance with one embodiment of the present invention.

FIG. 2 illustrates control circuit 24 in greater detail. Power supply 36 includes a capacitor C7 that provides a low impedance for incoming RFI from vehicle power source 22 (FIG. 1), and in conjunction with an inductor L1 reduces switching noise impressed onto vehicle power. A capacitor C1 provides energy storage required during the switching-off time, its capacitance being determined by ripple current limitations of the capacitor and rfi requirements. A resistor R1, a capacitor C2 and a zener diode CR2 provide regulated voltage V1 to the remainder of the control circuit. Unregulated power voltage VPWR, at the level of voltage supplied by power source 22 but with noise suppression supplied by capacitor C7 and inductor L1, is also made available at power supply 36 to the remainder of the control circuit.

Clock 26 includes a comparator U1B, resistors R2,R3, R4,R5 and R6, and a capacitor C3 configured as a conventional oscillator. A square-wave oscillator output is available at pin 2 of comparator U1B, while a quasi-triangular wave is available across capacitor C3. Output pin 2 of comparator U1B is connected to a flip-flop U2A within pulse blanking circuit 28. Flip-flop U2A effectively divides the frequency of clock 26 by two, providing a square-wave output at fifty percent duty cycle. A comparator U1A within pulse blanking circuit 28 receives a triangular wave input from across capacitor C3, and is configured with associated resistors R7,R8 and R9 and capacitor C4 to compare the triangular clock output across capacitor C3 to a percentage of supply voltage V1. Comparator U1A enables operation of power stage 30 only when the triangular output of clock 26 is above this percentage of supply voltage V1 (determined by voltage dividing resistors R7 and R8), and thus prevents simultaneous conduction of the electronic switches in power stage 30 during transition of the Q and Q outputs of flip-flop U2A.

Power stage 30 includes NAND gates U3A and U3B, which combine the divided clock signal output from flip-flop U2A and the blanking pulse output from comparator U1A to drive the push-pull predriver transistors Q2 and Q5. Transistors Q2,Q5, together with biasing resistors R15,R16 and R17, provide drive current to output power stage transistor Q1 through resistor R21. In the same way, NAND gates U3C and U3D combine the divided clock output of flip-flop U2A with the blanking pulse output of comparator U1A to drive push-pull predriver transistors Q4,Q6. Transistors Q4,Q6, together with biasing resistors R18,R19 and R20, provide drive to power stage transistor Q3 through resistor R22. Resistors R21 and R22 limit the dV/dt of the drain of output transistors Q1,Q3 respectively. A transformer T1 has windings 40,42,44,46 connected in series with polarities additive, as shown in FIG. 2. The junction of transformer windings 42,44 is connected to power supply 36 to receive unregulated voltage VPWR. Winding 40 is connected through a fuse F1 to power transistor Q1, while winding 46 is connected through a fuse F2 to power transistor Q3. Power transistors Q1,Q3 thus provide current paths from VPWR through opposite pairs of transformer windings during alternate cycles of the output of flip-flop U2A.

Output stage 34 includes a dual Schottky diode CR3,CR4 having anodes connected to the junctions of winding pairs 40,42 and 44,46 respectively. The cathodes of diode CR3, CR4 are connected across a capacitor C6 and a resistor 23, and thence to pump motor 14 (FIG. 1). Dual diode CR3,CR4 thus commutates or rectifies the voltage across transformer winding 42 when transistor Q1 is conductive and winding 44 when transistor Q3 is conductive. Due to the transformer action, these voltages are effectively added to supply voltage VPWR as a function of the number of turns in all windings 40,42,44 and 46. Resistor R23 provides a minimum current draw to control inductive spikes in the event the circuit is operated without a load. Capacitor C6 filters the high frequency components of the commutated output signal, reducing emitted EMI.

Control stage 32 functions to boost power applied to the pump motor during low supply voltage conditions, and to disable operation of circuit 24 under normal operating conditions. A resistor R10 and a diode CR1, connected in series, provide an absolute voltage reference (approximately 0.6 volts) that is stable independent of input voltage from power source 22. A comparator U1C compares this reference voltage with a percentage of voltage VPWR derived from resistive voltage divider R11,R12 and R13, with a filter capacitor C5 being connected across resistor R13. The output of comparator U1C connected to NAND gates U3A and U3C is phased such that, when input voltage VPWR is below the point where Q1 and Q3 can switch adequately, power output stage 30 is disabled. This feature saves the output transistors from over dissipation when the available gate voltage results in operation in the linear region. A second comparator U1D also compares the reference voltage across diode CR1 with a higher percentage of voltage VPWR at the junction of resistors R11,R12. The output of comparator U1D to NAND gates U3A,U3C. Comparator U1D is phased such that, when input voltage VPWR is high enough so that the pump does not need any voltage gain or boost, power output stage 30 is disabled.

Control circuit 24 thus functions to monitor vehicle power source 22. During normal operation when the voltage level available at power source 22 is sufficient in and of itself to drive motor 14 and pump 16, power stage 30 of control circuit 24 is disabled by comparator U1C of control stage 32, and pump power is drawn solely from voltage VPWR through transformer coils 42,44 and diodes CR3 and CR4. However, when control circuit 32 detects that the voltage available at power source 22 is inadequate to provide desired operation at motor 14 and pump 16—i.e., when power stage 30 is enabled by comparator U1C of control stage 32 and not disabled by comparator U1D (when voltage VPWR is too low)—control circuit 32 enables operation of power stage 30. Power transistors Q1,Q3 are activated on alternating half-cycles of flip-flop U2A, with the output transitions blanked by comparator U1A. Power stage 30 thereby boosts power applied to the pump motor through transformer T1. For example, a vehicle may require that fuel be supplied at minimum flow and pressure when the power available at the vehicle battery is only six volts, which is typical of starting conditions in a cold climate. If the pump were designed to provide the required minimum flow and pressure at this six-volt level, the motor would run at excessive speed and provide excessive flow and pressure at a normal operating voltage of 13.5 VDC. However, if the low voltage requirement of the fuel pump and motor were to be limited to 9 VDC, the speed and flow increase under normal operating conditions would be greatly reduced. Control circuit 24 is configured under these circumstances to provide voltage gain at a factor of 1.5 when vehicle voltage is at or below this nine-volt level, effectively reducing the pump operating voltage range to a range of 9 to 14.5 volts from a range of 6 to 14.5 volts.

Fuses F1,F2 (FIG. 2) provide fail-safe operation. In the event of failure of output stage 30, pulse blanking stage 28, clock stage 26 or control stage 32, non-boosted pump voltage VPWR will be available to the pump through transformer windings 42,44 and diode pair CR3,CR4 as previously described. For example, if a failure results in transistor Q1 being turned on all of the time, the core of transformer T1 will saturate, causing a fault current to flow from voltage VPWR through transformer windings 42,40, fuse F1 and transistor Q1. Fuse F1 is sized such that it opens under these conditions, disabling one-half of the power stage circuit. If the fault is such that transistor Q3 is still being switched, it will follow a similar pattern and fuse F2 will clear. If transistor Q3 is not switching, the result will be the same. Once fuses F1 and F2 have cleared, a current path exists from voltage VPWR through transformer windings 42,44 and diode pair CR3,CR4 to the pump motor.

Figure 3:
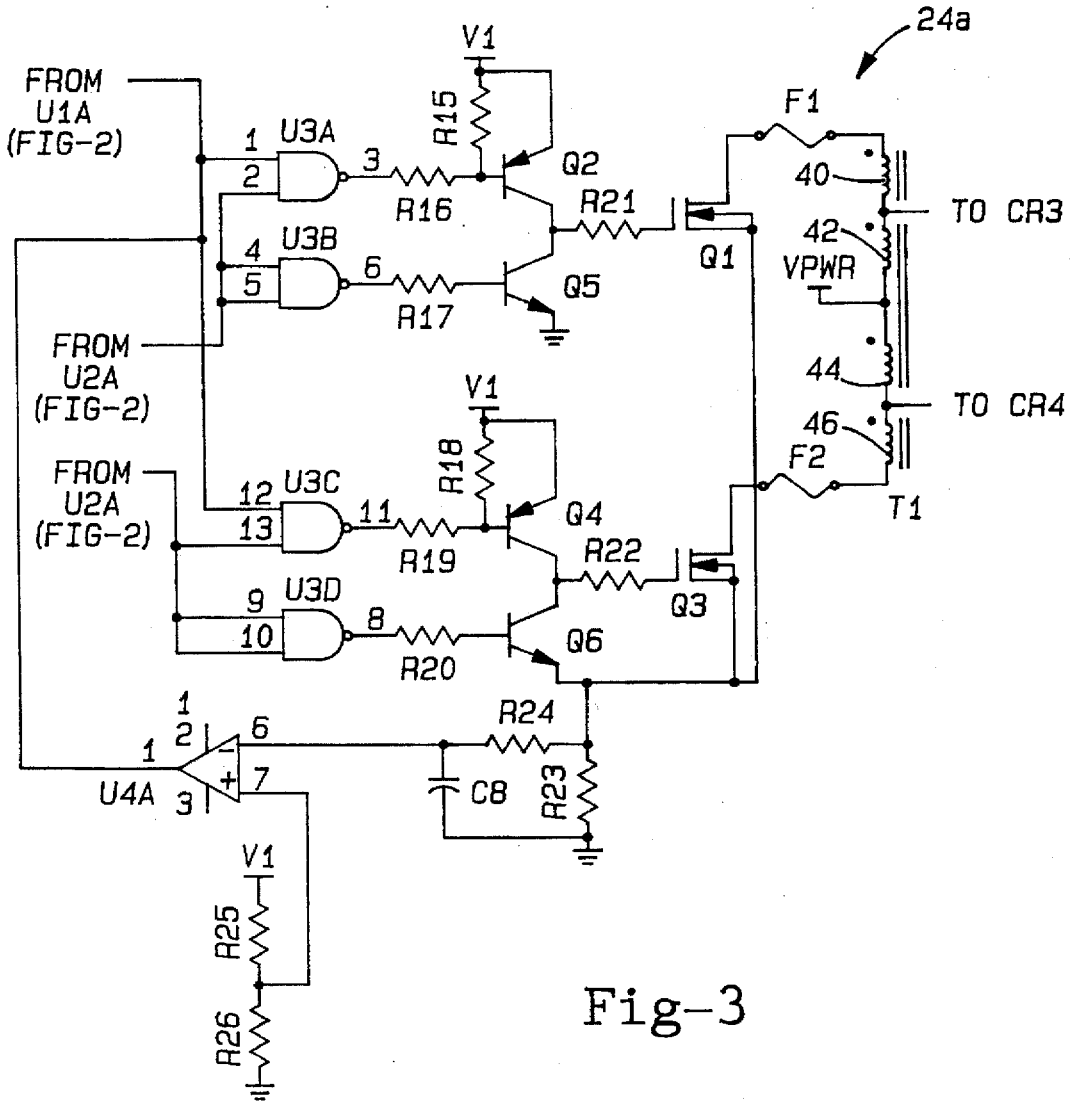
FIG. 3 is a fragmentary electrical schematic diagram that illustrates a modification to the control circuit of FIG. 2.

FIG. 3 illustrates a modification 24A to control circuit 24 illustrated in FIG. 2. A comparator U4A receives a reference input from the voltage divider R25,R26 and a signal input through resistor R24 from the drain of transistor Q3. The drain of transistor Q3 is also connected to ground through a resistor R23, and a capacitor C8 is connected across resistors R23,R24. The signal input to comparator U4A is thus directly proportional to transformer current. Comparator U4A compares this transformer current to the reference supplied by resistors R25,R26. If the transformer current exceeds the predetermined value provided by such reference voltage, NAND gates U3A and U3C, and thus output stage 30, are effectively disabled. This feature provides active current limiting of the output, as well as effectively skewing the duty cycle of the output to keep the transformer excitation current balanced to an acceptable level.

Figure 4:
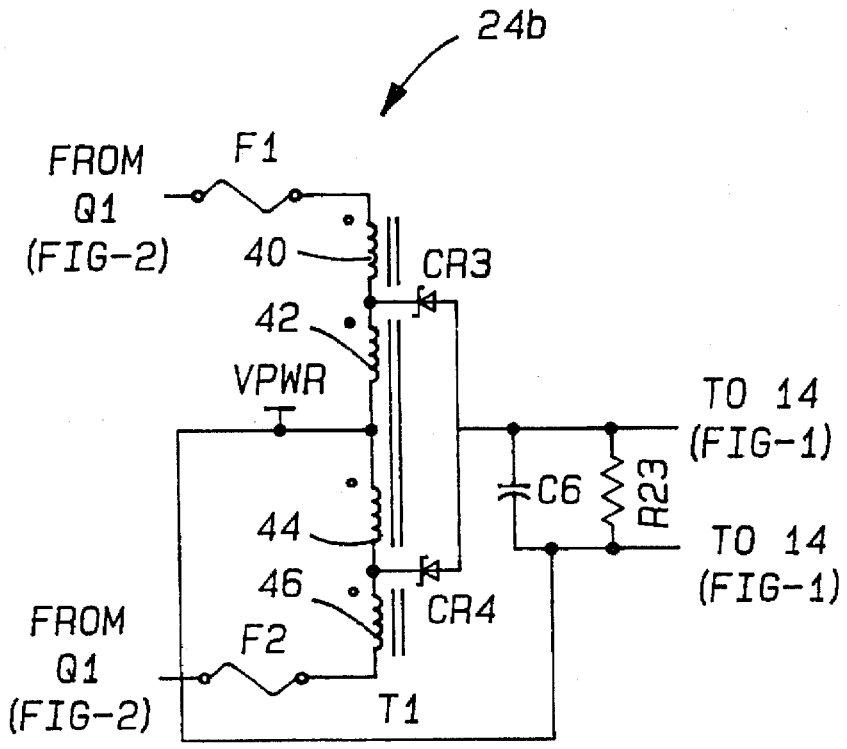
FIG. 4 is a fragmentary schematic diagram that illustrates another modification to the control circuit of FIG. 2.

FIG. 4 illustrates another modification 24*b* to the preferred control circuit illustrated in FIG. 2. In the embodiment of FIG. 4, the output is configured to subtract the boost voltage at transistors Q1, Q3 from input voltage VPWR. The boost voltage is continuously applied at transistors Q1, Q3, and cuts VPWR as a function of the ratio of turns in transformer coils 40, 42, 44, 46. The difference between VPWR and the boost voltage is applied across pump motor 14. This embodiment is useful for adjusting a 24 volt system to operate a 12 volt pump motor, for example.

Figure 5:
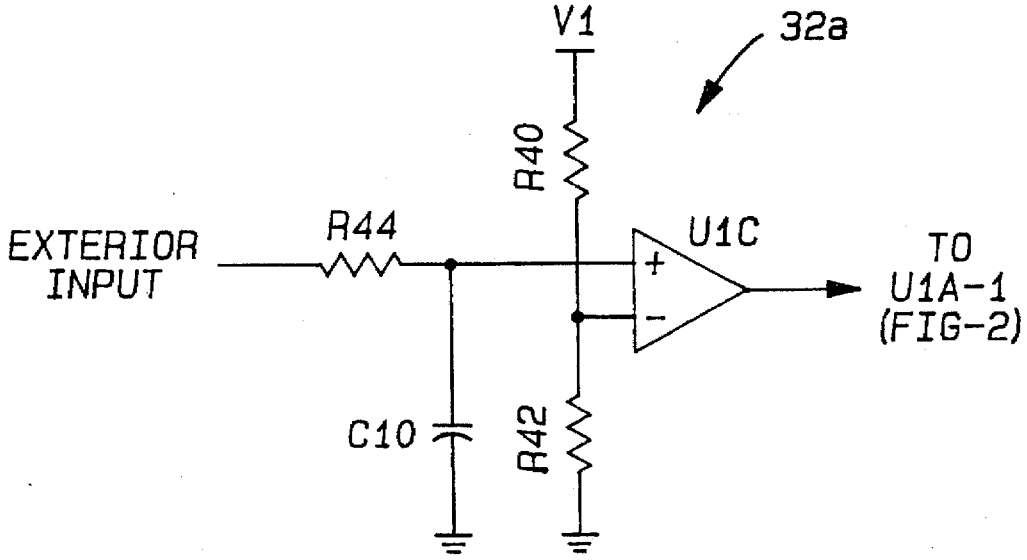
FIG. 5 is a fragmentary electrical schematic diagram of a circuit for coupling an external control signal to the circuit of FIG. 2.

FIG. 5 illustrates a modification to FIG. 2, in which control stage 32 in FIG. 2 (and FIG. 1) is replaced in a modified control stage 32*a*. Comparator U1C receives a reference input from a voltage divider R40, R42, and a signal input through a resistor R44 from an external source. A capacitor C10 is connected across the signal input of comparator U1C to reduce electromagnetic interference. The output of comparator U1C is connected to U1A-1 (FIG. 2). The external input may be supplied by an engine control unit, or responsive to a select engine parameter such as throttle angle, manifold air pressure, engine speed, etc. Thus, pump voltage is selectively boosted in response to one or more selected engine conditions—e.g., high engine load. It will be appreciated, of course, that control stages 32, 32*a* may be employed together to boost pump voltage either when supply voltage is low or responsive to engine conditions.

We claim:

1. A fuel delivery system for an internal combustion engine that comprises a fuel pump having a d.c. electrical motor for driving said pump at a speed that varies as a function of electrical power applied to said motor and circuit means for applying electrical power to said motor from a source of d.c. potential, characterized in that said circuit means includes means responsive to voltage level at said source of d.c. potential for automatically increasing electrical power applied to said motor from said source when voltage available at said source decreases to a preselected level, including a d.c.-to-d.c. converter having a transformer, rectifier means coupling said transformer to said motor and switch means for applying alternating current to said transformer when voltage available at said source of d.c. potential decreases to said preselected level, and means connecting said source of d.c. potential to said transformer such that said motor draws power from said source of d.c. potential through said transformer and said rectifier means during both operation and non-operation of said switch means.

2. The system set forth in claim 1 further comprising oscillator means for providing said alternating current, and said switch means comprises electronic power switch means responsive to said oscillator means.

3. The system set forth in claim 2 wherein said electronic power switch means comprises first and second power switch means coupled to said oscillator means for applying current of alternating polarity to said transformer means during alternate output cycle portions from said oscillator means.

4. The system set forth in claim 3 wherein said circuit means further comprises means coupled to said oscillator means to prevent simultaneous conduction of said first and second power switch means during transitions of said oscillator means between said alternate output cycle portions.

5. The system set forth in claim 1 further comprising fuse means connecting said power switch means to said transformer, said fuse means being sized such that circuit failure at said power switch means opens said fuse means to permit continued operation of the pump motor from said source of d.c. potential through said transformer and said rectifier means.

6. The system set forth in claim 1 further comprising current feedback means coupled to said power switch means and responsive to current in said transformer for terminating operation of said power switch means when current in said transformer increases to a preselected level.

7. The system set forth in claim 1 wherein said means responsive to said predetermined condition comprises means responsive to an external control signal.

8. A fuel delivery system for an internal combustion engine that comprises a fuel pump having an electrical d.c. motor for driving said pump at a speed that varies as a function of electrical power applied to said motor and circuit means for applying electrical power to said motor from a source of d.c. potential, characterized in that said circuit means includes a d.c.-to-d.c. converter having a transformer, rectifier means coupling said transformer to said motor, switch means for applying alternating current to said transformer, means connecting said source of d.c. potential to said transformer such that said motor draws power from said source of d.c. potential through said transformer and said rectifier means during both operation and non-operation of said switch means, and oscillator means for providing said alternating current, said switch means comprising electronic power switch means responsive to said oscillator means.

9. The system set forth in claim 8 wherein said electronic power switch means comprises first and second power switch means coupled to said oscillator means for applying current of alternating polarity to said transformer means during alternate output cycle portions from said oscillator means.

10. The system set forth in claim 9 wherein said circuit means further comprises means coupled to said oscillator means to prevent simultaneous conduction of said first and second power switch means during transitions of said oscillator means between said alternate output cycle portions.

11. A fuel delivery system for an internal combustion engine that comprises a fuel pump having an electrical d.c. motor for driving said pump at a speed that varies as a function of electrical power applied to said motor and circuit means for applying electrical power to said motor from a source of d.c. potential, characterized in that said circuit means includes a d.c.-to-d.c. converter having a transformer, rectifier means coupling said transformer to said motor, switch means for applying alternating current to said transformer, means connecting said source of d.c. potential to said transformer such that said motor draws power from said source of d.c. potential through said transformer and said rectifier means during both operation and non-operation of said switch means, and fuse means connecting said switch means to said transformer, said fuse means being sized such that circuit failure at said switch means opens said fuse means to permit continued operation of the pump motor from said source of d.c. potential through said transformer and said rectifier means.

12. The system set forth in claim 11 further comprising oscillator means for providing said alternating current, said switch means comprising electronic power switch means responsive to said oscillator means.

13. The system set forth in claim 12 wherein said electronic power switch means comprises first and second power switch means coupled to said oscillator means for applying current of alternating polarity to said transformer means during alternate output cycle portions from said oscillator means.

14. The system set forth in claim 13 wherein said circuit means further comprises means coupled to said oscillator means to prevent simultaneous conduction of said first and second power switch means during transitions of said oscillator means between said alternate output cycle portions.

15. The system set forth in claim 11 further comprising current feedback means coupled to said switch means and responsive to current in said transformer for terminating operation of said switch means when current in said transformer increases to a preselected level.

16. A fuel delivery system for an internal combustion engine that comprises a fuel pump having an electrical d.c. motor for driving said pump at a speed that varies as a function of electrical power applied to said motor and circuit means for applying electrical power to said motor from a source of d.c. potential, characterized in that said circuit means includes a d.c.-to-d.c. converter having a transformer, rectifier means coupling said transformer to said motor, switch means for applying alternating current to said transformer, and current feedback means coupled to said switch means and responsive to current in said transformer for terminating operation of said switch means when current in said transformer increases to a preselected level.

* * * * *